United States Patent [19]

Bayless

[11] Patent Number: 5,003,652

[45] Date of Patent: Apr. 2, 1991

[54] COLLAPSIBLE HAMMOCK

[76] Inventor: Lee Bayless, 611 N. Geneva, No. 139, Glendale, Calif. 91206

[21] Appl. No.: 467,503

[22] Filed: Jan. 19, 1990

[51] Int. Cl.[5] ..... A45F 3/24

[52] U.S. Cl. ..... 5/129; 5/122; 5/127

[58] Field of Search ..... 5/120, 122, 123, 127, 5/128, 129

[56] References Cited

U.S. PATENT DOCUMENTS

| | | | |
|---|---|---|---|
| 531,727 | 1/1895 | Keegan, Sr. et al. | 5/129 |
| 781,609 | 1/1905 | Lawson | 5/127 |
| 986,375 | 3/1911 | Fitzner et al. | 5/127 |
| 1,217,963 | 3/1917 | Laing | 5/127 |
| 1,320,381 | 11/1919 | Dittrick | 5/129 |
| 3,593,352 | 7/1971 | Britt | 5/129 X |

FOREIGN PATENT DOCUMENTS

| | | | |
|---|---|---|---|
| 500604 | 3/1959 | Canada | 5/129 |

*Primary Examiner*—Michael F. Trettel
*Attorney, Agent, or Firm*—James E. Brunton

[57] ABSTRACT

A collapsible, self-supporting, fully portable hammock assembly in which the supporting framework is fabricated of light weight metal components. The apparatus can be quickly and easily extended from a compact, collapsible configuration into a self-supporting highly stable structure which safely carries the hammock. When the apparatus is in its folded configuration, it is mounted on a wheeled base assembly which permits easy transport of the collapsed apparatus from place to place.

10 Claims, 4 Drawing Sheets

3

42
H
36
38
10
11
35
30
T
44
12
7
C
12b
24
27
31
34
TM
40
9
18
EM
33
8
12
52
50
26
54
55
19
53
32
28
16
23
29
22

COLLAPSIBLE HAMMOCK

BACKGROUND OF THE INVENTION

1. Field of the Invention

The present invention relates generally to hammocks. More particularly, the invention concerns a collapsible, easily portable hammock for use in the outdoors such as at the beach or in the park or in the yard.

2. Discussion of the Invention

Hammocks have been known for many, many years, and have been widely used for both recreational and utilitarian purposes. Because of the recreational popularity of hammocks, numerous types of foldable hammock supporting structures for holding the hammock in an outstretched position have been suggested. However, such foldable or collapsible hammock supports, are typically complex in construction, and are often unwieldy, and difficult to use. Further, such structures are generally heavy, quite bulky when in a collapsed or folded configuration, and, accordingly, are extremely difficult to transport from place to place.

As will become more apparent from the discussion which follows, the apparatus of the present invention overcomes the drawbacks of the prior art collapsible hammocks, and provides for the first time a light weight, easy to operate hammock assembly, which folds into a compact configuration. The hammock support is conveniently mounted on a wheeled base so that it may readily be transported much in the same manner as a golf cart.

SUMMARY OF THE INVENTION

It is an object of the present invention to provide a collapsible, self-supporting, fully portable hammock assembly in which the supporting framework is fabricated of light weight, metal components. The metal components of the apparatus are uniquely interconnected so that the device can be easily and quickly extended from a compact, collapsible configuration into a self-supporting structure which safely carries the supporting hammock.

Another object of the invention, is to provide an improved collapsible hammock stand of the aforementioned character which, when in its folded configuration, is mounted on a wheeled base assembly which permits easy transport of the collapsed apparatus from place to place.

Another object of the invention, is to provide an improved collapsible hammock assembly as described in the preceding paragraphs in which the framework, when extended for use, provides upstanding end portions to which the hammock can be easily interconnected so that the central portion of the hammock is elevated above the supporting surface a sufficient distance to permit flexing in a downward direction for increased comfort.

Still another object of the present invention, is to provide a collapsible hammock structure which when extended includes rigid, outwardly extending stabilizer members located at either end of the assembly so as to provide substantial lateral stability to the assembly.

Another object of the invention, is to provide a collapsible self-supporting, portable hammock assembly of the class described which is fabricated of readily commercially available metal tubular parts which are interconnected by common hardware items so that the apparatus can be manufactured in a most cost effective manner.

Yet another object of the invention, is to provide a collapsible hammock assembly which is light weight, compact and can be easily operated by persons of slight stature.

DESCRIPTION OF THE INVENTION

Figure 1:
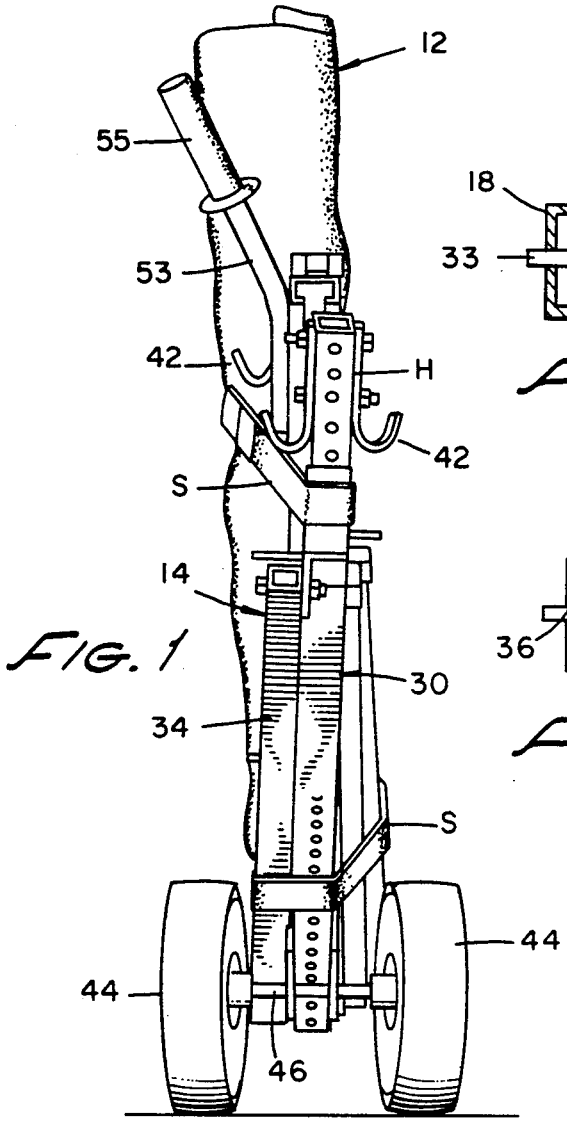
FIG. 1 is a generally perspective, view of the apparatus of the invention in a collapsed, transportable configuration.
Figures 5, 7:
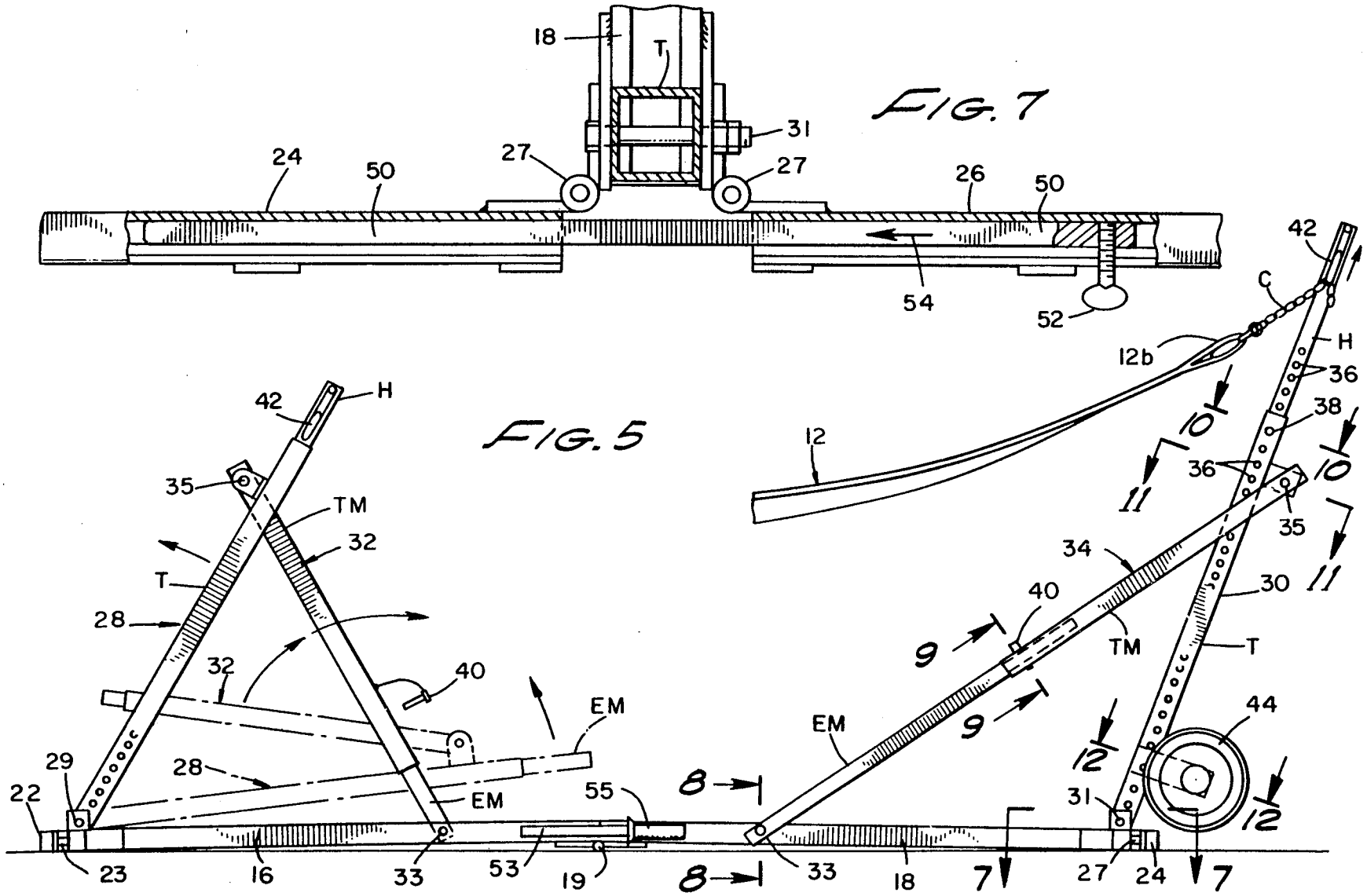
FIG. 5 is a side elevational view of the apparatus as it appears in a further unfolded configuration.
FIG. 7 is a cross-sectional view, taken along lines 7—7 of FIG. 5.
Figure 13:
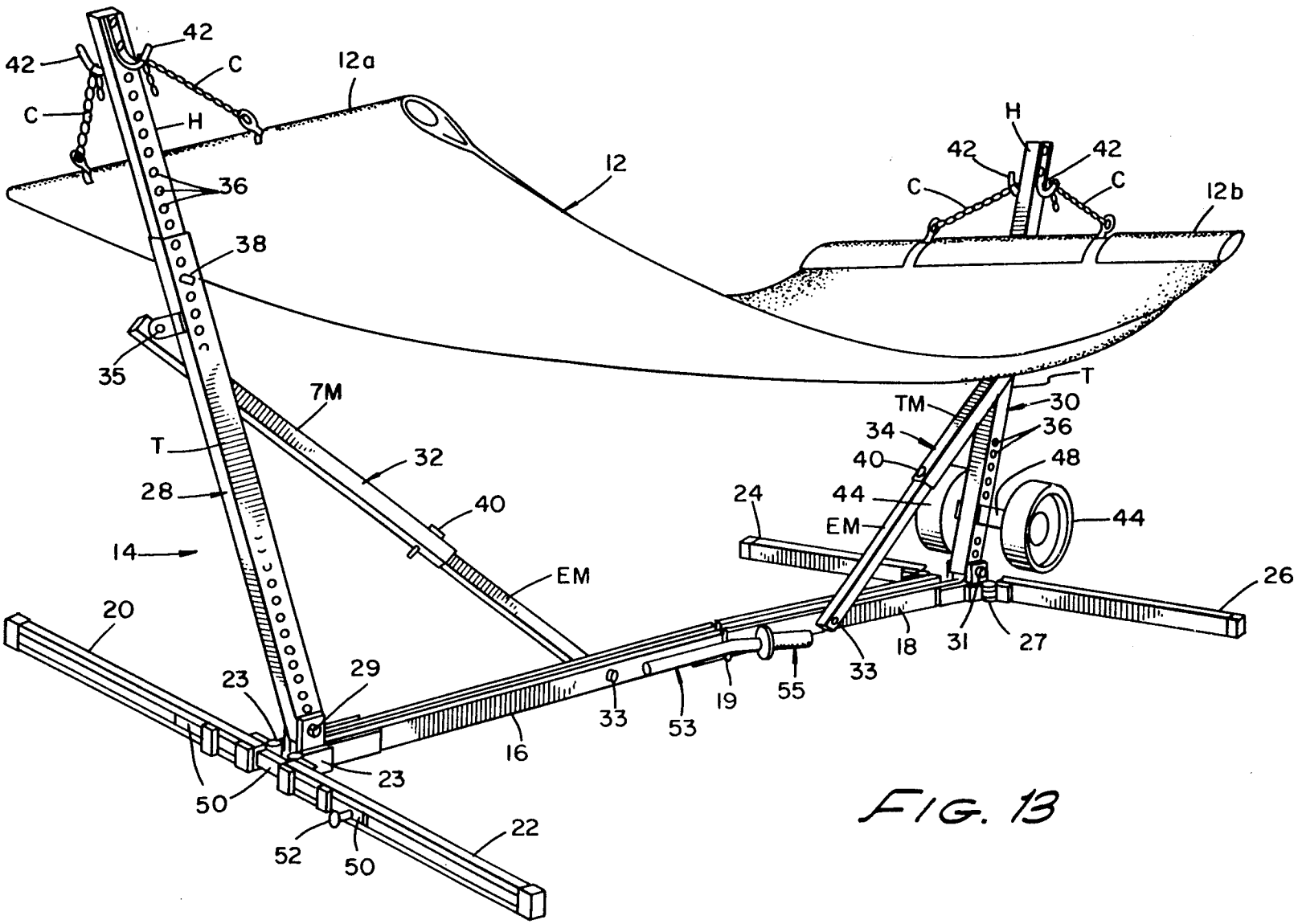
FIG. 13 is a generally perspective view of the apparatus of the invention in a fully expanded hammock supporting configuration.

Referring to the drawings, and particularly to FIGS. 1 through 4. The collapsible hammock assembly of the present invention comprises a hammock 12 and a wheel mounted hammock support unit, generally designated in FIG. 1 by the numeral 14. In the transport configuration of the apparatus as shown in FIG. 1 hammock 12 is removably connected to the unit by a pair of straps S. As best seen by referring to FIGS. 4 and 13 the collapsible hammock assembly comprises first and second hingeably connected base members 16 and 18; first and second stabilizing members 20 and 22 hingeably connected to first base member 16; third and fourth stabilizing members 24 and 26 hingeably connected to said second base member 18; a first hammock support assembly 28 pivotally connected to first base member 16; and a second hammock support assembly 30 pivotally connected to second base member 18. Interconnecting first base member 16 and first hammock support assembly 28 is a first brace assembly 32 (FIGS. 5 and 13). Interconnecting second base member 18 and second hammock support assembly 30 is a second brace assembly 34. The construction and function of these brace assemblies will be discussed further hereinafter.

First and second base members 16 and 18 are connected by a leaf hinge 19 and are movable from a first collapsed position shown in FIG. 1 to a second extended substantially in-line-position shown in FIG. 13. First and second stabilizing members 20 and 22 are connected by leaf hinges 23 to base member 16 (FIG. 4) and are movable from a first collapsed position shown in FIG. 1 wherein the members are disposed closely adjacent to first member 16 to a second extended position wherein the members extend generally perpendicularly to first base member 16. Similarly, third and fourth stabilizing member 24 and 26 are connected by leaf hinges 27 to base member 18 (FIG. 4) and are movable from a first collapsed position shown in FIG. 1 wherein said members are disposed closely adjacent to second base member 18 to a second extended position wherein the members extend generally perpendicularly to second base member. As best seen in FIG. 13, when the stabilizing members are extended to their second positions, they provide substantial lateral support to the hammock assembly.

Referring now to FIGS. 5 and 13 first hammock support assembly 28 is pivotally connected to base member 16 by a pivot pin 29 and is movable between a collapsed position wherein it is closely adjacent to first base member 16 into an operative position as shown in FIG. 13. Similarly, second hammock support assembly 30 is pivotally connected to base member 18 by a pivot pin 31 and is movable from a collapsed position wherein it is closely adjacent second base member 18 into the operative position shown in FIG. 13.

Figure 10:
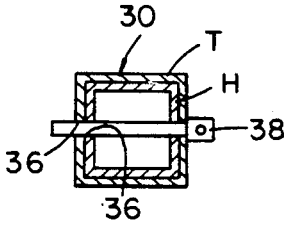
FIG. 10 is a cross-sectional view, taken along lines 10—10 of FIG. 5.

Each of the hammock support assemblies 28 and 30 comprise a tubular member T and height adjustment member H telescopically receivable within the tubular member. With this construction the overall height of the ends of the hammock 12 can be conveniently adjusted. As indicated in FIGS. 5 and 13, the tubular members T as well as the height adjustment members H are provided with a multiplicity of apertures 36 within which a locking pin 38 is closely received (FIG. 10).

Figure 8:
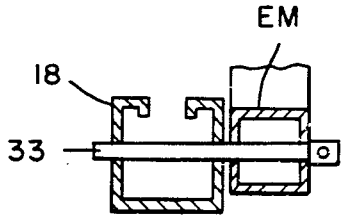
FIG. 8 is a cross-sectional view taken along lines 8—8 of FIG. 5.
Figure 9:
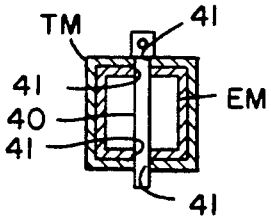
FIG. 9 is a cross-sectional view, taken along lines 9—9 of FIG. 5.
Figure 11:
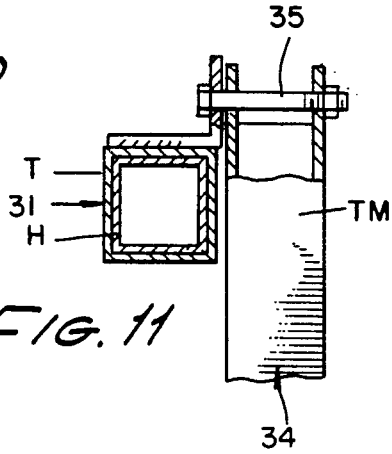
FIG. 11 is a cross-sectional view, taken along lines 11—11 of FIG. 5.
Figure 2:
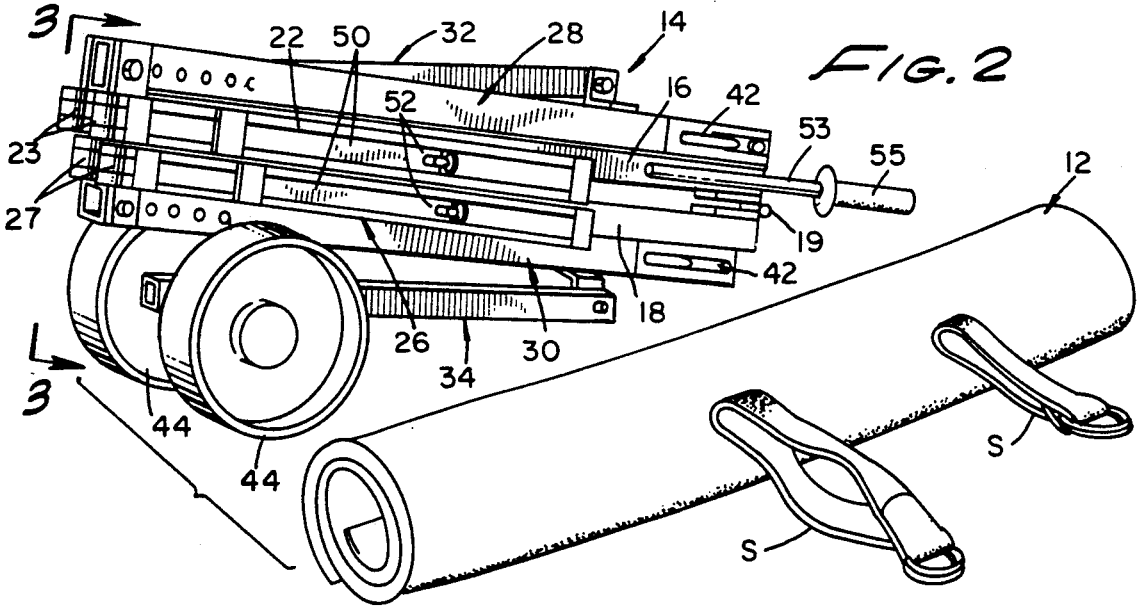
FIG. 2 is a generally perspective exploded view of the apparatus, showing the hammock portion removed from the support frame.

Referring particularly to FIG. 5, first and second brace assemblies 32 and 34 comprise a tubular member TM and an extension member EM which is telescopically receivable within the tubular member. Members EM are pivotally connected to base members 16 and 18*b* pivot pins 33 (FIG. 8). Members TM are pivotally connected to hammock support assemblies 28 and 30 by pivot pins 35 (FIG. 11). Members TM and EM are also apertured along their length to receive a locking pin 40. After assembly 28 is moved from the position shown in the phantom lines to the position shown in the solid lines locking pin 40 is removed in the manner shown in the left-hand portion of FIG. 5. Hammock support assembly 28 can then be moved to the angularly upwardly extending position shown in the right-hand portion of FIG. 5. It is to be noted that such angularly upward movement of the hammock support assembly results in member EM telescoping outwardly with respect to member TM to the operative position shown in the right-hand portion of FIG. 5. Once this operative position has been realized, locking pin 40 is reinserted into indexed apertures 41 (FIG. 9), thereby holding the assembly in a rigid braced configuration of the character shown in FIGS. 5 and 13.

Hammock support assembly 30 is similarly moved to the operative position shown in FIG. 13. It is to be observed by referring to FIGS. 4, 5 and 13, that as the base members 16 and 18 move from the position shown in 4 to the in-line-position shown in FIG. 13, the brace members will pivot about their points of interconnection with the hammock support members as well as with their points of interconnection the first and second base members. This unique pivotal connection coupled with the ability of the extension members to telescope within their respective tubular members after pins 40 are removed permits the apparatus to be unfolded from the configuration shown in FIG. 1 to the configuration shown in FIG. 4, through the configuration shown in FIG. 5 to the final operative configuration shown in FIG. 13.

Figure 12:
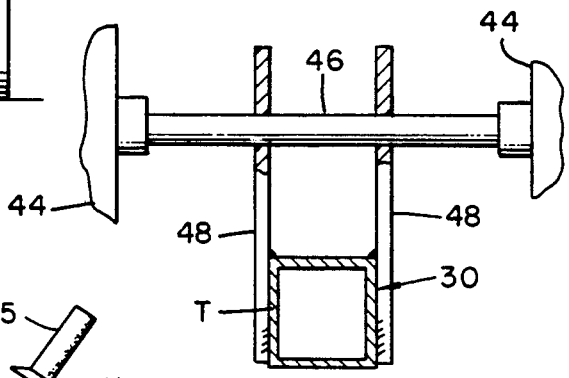
FIG. 12 is a cross-sectional view, taken along lines 12—12 of FIG. 5.
Figure 6:
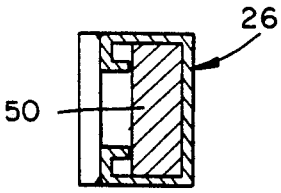
FIG. 6 is a cross-sectional view, taken along lines 6—6 of FIG. 3.
Figure 4:
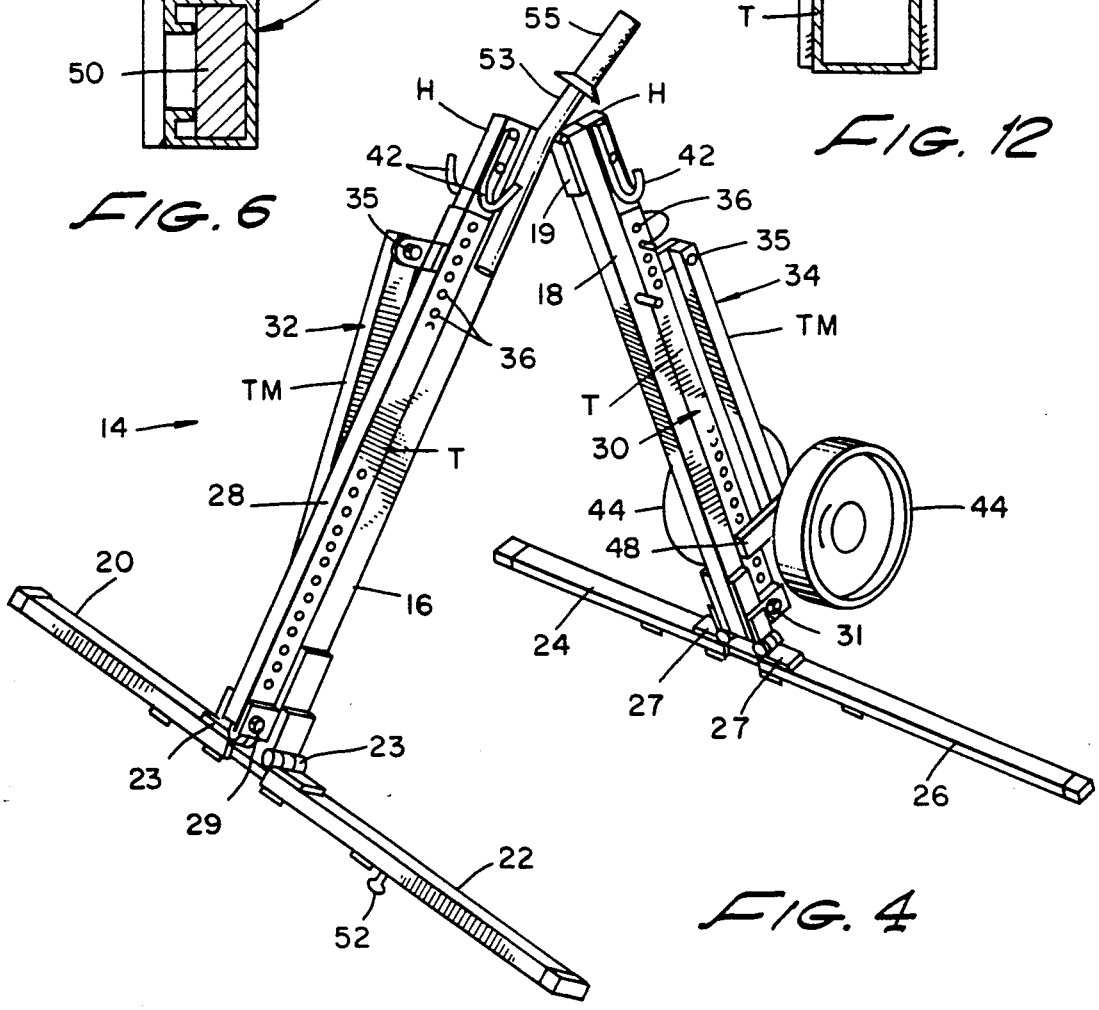
FIG. 4 is a generally perspective view of the apparatus in a partially, unfolded orientation.

In the operative position of the apparatus shown in FIG. 13, the first and second ends 12*a* and 12*b* of the hammock are supported at a height such that the center portion of the hammock is provided with ample clearance with respect to the ground to permit flexing and free swinging movement of the hammock within the hammock support assembly. As best seen in FIG. 12, connector means are provided proximate each of the first and second ends of the hammock for connecting the hammock to the support member. In the form of the invention shown in the drawings the connector means comprise a pair of spaced apart chains C attached at the first and second ends of the hammock 12. Chains C are receivable over a pair of hook-like extensions 42 provided on either side of the height adjustment members H of the hammock support assemblies.

Forming an important aspect of the apparatus of the present invention is wheel means connected to second hammock support assembly 30 for rollably transporting the hammock assembly when it is in the collapsed configuration shown in FIG. 1. In the present form of the invention the wheel means are provided as a pair of transversely spaced wheels 44 rotatably carried by an axle 46 which is received through apertures provided in a pair of spaced apart arms 48 which are affixed to and extend outwardly from tubular member T of hammock support assembly (FIG. 12).

Also forming an important aspect of the present invention is locking means which are operatively associated with the stabilizing members for locking the stabilizing members in the second extended position shown in FIG. 13. As best seen by referring to FIGS. 3, 6, 7 and 13, the locking means are here provided in the form of a locking bar 50 which are slidably receivable within channels formed interiorly of stabilizing members 20, 22, 24 and 26. Set screws 52 hold the locking bar in position within the channels of members 22 and 26.

Figure 3:
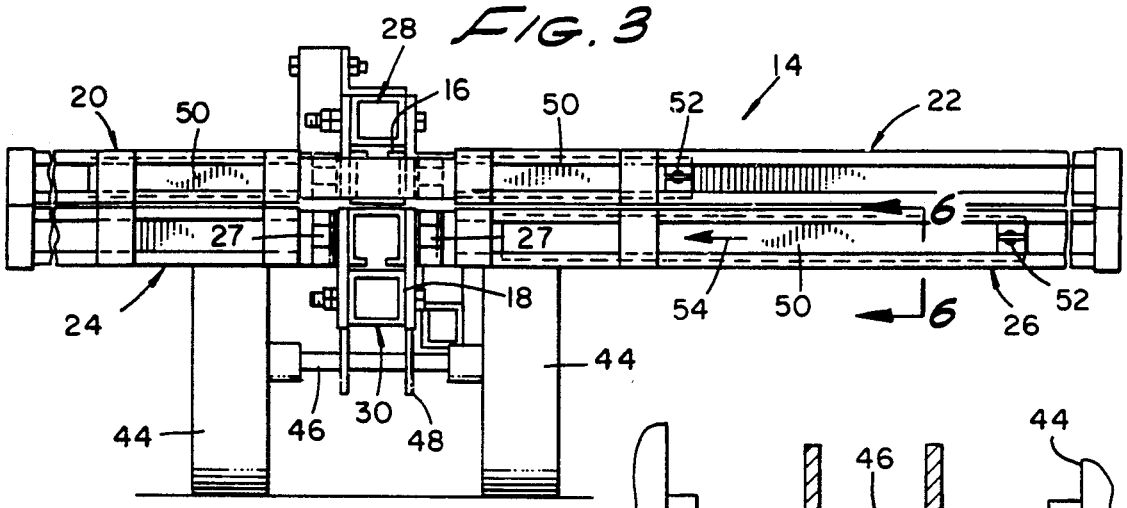
FIG. 3 is a view taken along lines 3—3 of FIG. 2.

After the stabilizing members have been moved into their extended, operative position as shown in FIG. 13, and locking screws 52 loosened, the locking bars 50 can be slidably moved in the direction shown by the arrows 54 in FIGS. 3 and 7 so as to extend into the channel formed within the oppositely disposed, companion stabilizer member. When the locking bars are in the extended locking position, locking screws 52 can be tightened to lock the bar in the locking position (see for example members 20 and 22 of FIG. 3 wherein bar 50 is in the extended, locking position). With the locking bar in the locking position, not only are the stabilizing members prevented from swinging movement toward and away from the base members, but the stabilizing members also tend to increase the lateral support provided to the assembly by the stabilizing members.

To assist in steering the apparatus during transport hand engaging means are provided. As best seen in FIG. 1, the hand engaging means is here provided in the form of an upwardly extending handle bar 53 having a hand grip 55 located proximate its upper end. When the apparatus is in the collapsed configuration shown in FIG. 1 the handle bar provides a convenient means for rolling the device on wheels 44 much in the same manner as a golf cart.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A collapsible hammock assembly comprising:

(a) a hammock having first and second ends;

(b) first and second hingeably connected base members movable from a first collapsed positioned to a second extended, substantially in-line position;

(c) first and second stabilizing members hingeably connected to said first base member and movable from a first collapsed position wherein said members are disposed closely adjacent to said first base member to a second extended position wherein said members extend generally perpendicularly to said first base member;

(d) third and fourth stabilizing members hingeably connected to said second base member and movable from a first collapsed position wherein said members are disposed closely adjacent to said second base member to a second extended position wherein said members extend generally perpendicularly to said second base member;

(e) a first hammock support assembly for supporting said first end of said hammock pivotally connected to said first base member for movement between a collapsed position to an operative position;

(f) a second hammock support assembly for supporting said second end of said hammock pivotally connected to said second base member for movement between a collapsed position to an operative position;

(g) a first brace assembly having first and second end portions, said first portion being pivotally connected to said first base member and said second end portion being pivotally connected to said first hammock support assembly;

(h) a second brace assembly having first and second end portions, said first end portion being pivotally connected to said second base member and said second end portion being pivotally connected to said second hammock support assembly; and (i) wheel means connected to one of said first and second hammock support assemblies for rollably transporting said collapsible hammock assembly when in a collapsed configuration.

2. A collapsible hammock assembly as defined in claim 1 further including locking means operably associated with said stabilizing members for locking said stabilizing members in said second extended positions.

3. A collapsible hammock assembly as defined in claim 1 in which each of said brace assemblies comprises a tubular member and an extension member telescopically receivable within said tubular member, said extension members being pivotally connected to said base members.

4. A collapsible hammock assembly as defined in claim 1 in which each of said hammock support assemblies comprises a tubular member and a height adjustment member telescopically receivable within said tubular member, said tubular member being pivotally connected to said base members.

5. A collapsible hammock assembly as defined in claim 4 in which said hammock includes connector means proximate each of said first and second ends for connecting said hammock to a support member, and in which each of said height adjustment member includes members interconnectable with said connector means.

6. A collapsible hammock assembly as defined in claim 4 including means for securing each said height adjustment member in a fixed telescopic position relative to its respective said tubular member.

7. A collapsible hammock assembly comprising:

(a) a hammock having first and second ends;

(b) first and second hingeably connected base members movable from a first collapsed position to a second extended, substantially in-line-position;

(c) first and second stabilizing members hingeably connected to said first base member and movable from a first collapsed position wherein said members are disposed closely adjacent to said first base member to a second extended position wherein said members extend generally perpendicularly to said first base member;

(d) third and fourth stabilizing members hingeably connected to said second base member and movable from a first collapsed position wherein said members are disposed closely adjacent to said second base member to a second extended position wherein said members extend generally perpendicularly to said second base member;

(e) a first hammock support assembly for supporting said first end of said hammock pivotally connected to said first base member for movement between a collapsed position to an operative position;

(f) a second hammock support assembly for supporting said second end of said hammock pivotally connected to said second base member for movement between a collapsed position to an operative position;

(g) a first brace assembly including a tubular member and an extension member telescopically receivable within said tubular member, said extension member being pivotally connected to said first base member and said tubular member being pivotally connected to said first hammock support assembly; and (h) a second brace assembly including a tubular member and an extension member telescopically removable within said tubular member, being pivotally connected to said second base member and said tubular member being pivotally connected to said second hammock support assembly; and (i) wheel means connected to said first hammock support assembly for rollably transporting said collapsible hammock assembly when in a collapsed configuration.

8. A collapsible hammock assembly as defined in claim 7 in which each of said hammock support assemblies comprises a tubular member and a height adjustment member telescopically receivable within said tubular member, said tubular member being pivotally connected to said base members.

9. A collapsible hammock assembly as defined in claim 8 including means for securing each said height adjustment member in a fixed telescopic position relative to its respective said tubular member.

10. A collapsible hammock assembly as defined in claim 9 further including hand engaging means mounted on said first base member for steering said hammock assembly in a collapsed configuration.

* * * * *